US005358183A

United States Patent [19]

Kanda et al.

[11] Patent Number: 5,358,183

[45] Date of Patent: Oct. 25, 1994

[54] PNEUMATIC PULVERIZER AND PROCESS FOR PRODUCING TONER

[75] Inventors: Hitoshi Kanda; Satoshi Mitsumura, both of Yokohama; Kazuhiko Omata, Satte, all of Japan

[73] Assignee: Canon Kabushiki Kaisha, Tokyo, Japan

[21] Appl. No.: 183,253

[22] Filed: Jan. 19, 1994

Related U.S. Application Data

[63] Continuation of Ser. No. 912,694, Jul. 13, 1992, abandoned.

[30] Foreign Application Priority Data

May 8, 1992 [JP] Japan ..... 4-116172

[51] Int. Cl.[5] ..... B02C 19/06

[52] U.S. Cl. ..... 241/5; 241/24; 241/40

[58] Field of Search ..... 241/5, 19, 24, 40, 48, 241/52

[56] References Cited

U.S. PATENT DOCUMENTS

| | | | |
|---|---|---|---|
| 4,529,135 | 7/1985 | Urayama | 241/52 |
| 4,930,707 | 6/1990 | Oshiro et al. | 241/5 |
| 5,086,982 | 2/1992 | Hirano et al. | 241/5 |
| 5,111,998 | 5/1992 | Kanda et al. | 241/5 |

FOREIGN PATENT DOCUMENTS

| | | |
|---|---|---|
| 0445455 | 9/1991 | European Pat. Off. . |
| 0523653 | 1/1993 | European Pat. Off. . |
| 57-50554 | 3/1982 | Japan . |
| 58-143853 | 8/1983 | Japan . |
| 1148740 | 10/1989 | Japan . |
| 1254266 | 10/1989 | Japan . |

*Primary Examiner*—Eugenia Jones
*Assistant Examiner*—Allan M. Schrock
*Attorney, Agent, or Firm*—Fitzpatrick, Cella, Harper & Scinto

[57] ABSTRACT

A pneumatic pulverizer includes an accelerating tube for conveying and accelerating a material to be pulverlized by a high-pressure gas and a pulverizing chamber for finely pulverizing the material to be pulverized. The pulverizing chamber is provided with a colliding member having a colliding surface provided in opposed relation to an outlet of the accelerating tube. The colliding surface of the colliding member has a protruding central portion, and an outer peripheral colliding surface provided around the protruding central portion for secondarily pulverizing the material primarily pulverized by the protruding central portion. The pulverizing chamber has a side wall for performing tertiary pulverization on the material secondarily pulverized by the outer peripheral colliding surface.

17 Claims, 8 Drawing Sheets

PNEUMATIC PULVERIZER AND PROCESS FOR PRODUCING TONER

This application is a continuation-in-part of application Ser. No. 07/912,694, filed Jul. 13 1992, now abandoned.

BACKGROUND OF THE INVENTION

Field of the Invention

The present invention relates to a collision type pneumatic pulverizer for pulverizing powder material using a jet of gas (a high-pressure gas), and a process for producing a toner used for developing electrostatic images using such a pulverizer.

Related Background Art

Collision type pneumatic pulverizers which employ a jet of gas are designed to pulverize powder material by ejecting a flow of particle-gas mixture obtained by mixing a jet of gas with powder material from the outlet of an accelerating tube and thereby making the flow of particle-gas mixture collide against the colliding surface of a colliding member provided in front of the outlet of the accelerating tube.

A conventional collision type pneumatic pulverizer will be described in detail below with reference to FIG. 8.

In a conventional collision type pneumatic pulverizer, a colliding member 4 is provided in opposed relation to an outlet 13 of an accelerating tube 3 connected to a high-pressure gas supply nozzle 2. The powder material is sucked into the accelerating tube 3 from a powder material supply port 1 connected to the intermediate portion of the accelerating tube 3 by the flow of a high-pressure gas supplied to the accelerating tube 3. The sucked powder material is ejected together with the high-pressure gas in such a manner that it collides against the collision surface of the colliding member 4. Consequently, the powder material is pulverized due to the impact of the collision.

In the above-mentioned type of conventional pulverizer, the colliding surface 14 of the colliding member has a flat surface which is perpendicular to or inclined (by, for example, 45°) with respect to the direction of the flow of powder material-gas mixture (the axial direction of the accelerating tube), as shown in FIG. 8 or 9. The pulverizer having the former type colliding member is disclosed in Japanese Patent Application Laid-Open No. 57-50554, and the pulverizer having the latter type colliding member has been proposed in Japanese Patent Application Laid-Open No. 58-143853).

In the pulverizer shown in FIG. 8, the powder material having a large particle size is supplied into the accelerating tube 3 from the supply port 1. The supplied powder material is made to collide against the colliding surface 14 of the colliding member 4 by the jet of gas supplied from the jet nozzle 2 and is thereby pulverized. The pulverized powder is discharged to the outside of a pulverizing chamber from an exhaust port 5. However, in a case where the colliding surface 14 is perpendicular to the axial direction of the accelerating tube 3, the rate at which the powder material ejected from the jet nozzle 2 and the powder reflected by the colliding surface 14 co-exist near the colliding surface 14 is high, and the concentration of the powder near the colliding surface 14 is thus high, deteriorating the pulverization efficiency. Furthermore, the main collision is the primary collision on the colliding surface 14, and the secondary collision on a wall 6 of the pulverizing chamber is not effectively utilized. Furthermore, in a pulverizer in which the colliding surface is perpendicular to the accelerating tube 3, pulverization of a thermoplastic resin readily generate melting or agglomeration of the powder material due to the local heating generated during collision. Therefore, stable operation of the pulverizer is difficult and the pulverization capability is reduced. These in turn make the use of the powder at a high concentration difficult.

In the pulverizer shown in FIG. 9, since the colliding surface 14 is inclined with respect to the axial direction of the accelerating tube 3, the concentration of the powder near the colliding surface 14 can be reduced as compared with that in the pulverizer shown in FIG. 8. However, the pulverization pressure is dispersed and hence reduced. Furthermore, the secondary collision provided by the wall 6 of the pulverizing chamber cannot be utilized effectively.

In a pulverizer such as that shown in FIG. 9 in which the colliding surface 14 is inclined by 45° with respect to the accelerating tube, occurrence of the aforementioned problems can be lessened during pulverization of a thermoplastic resin. However, the impact force used in pulverization during collision is low, and pulverization by the secondary collision on the wall 6 of the pulverizing chamber is reduced. Thus, the pulverization capability is reduced to ½ or 1/1.5 of that of the pulverizer shown in FIG. 8.

Japanese Utility Model Application Laid-Open No. 1-148740 and Japanese Patent Application Laid-Open No. 1-254266 disclose the collision type pneumatic pulverizers which can overcome the aforementioned problems.

In the pulverizer disclosed in Japanese Utility Model Application Laid-Open No. 1-148740, a colliding surface 15 of a colliding member is disposed at a right angle with respect to the axis of the accelerating tube, and a conical protrusion 14 is provided on the colliding surface 15 so as to prevent generation of a reflected flow by the colliding surface, as shown in FIG. 11.

In the collision type pneumatic pulverizer proposed in Japanese Patent Application Laid-Open No. 1-254266, the distal end portion of the colliding surface of the colliding member is made conical, as shown in FIG. 10, so as to reduce the concentration of the powder near the colliding surface and thereby provide effective secondary collision on the wall 6 of the pulverizing chamber. The above-mentioned structures can eliminate the problems of the conventional pulverizers to a certain degree but cannot solve them sufficiently. Also, in recent years, there have been a demand for finer pulverization and for a pulverizer exhibiting better pulverization efficiency.

The toner or the coloring resin powder for toner used in the image forming method by the electrophotographic process generally contains at least a binder resin and a coloring agent or magnetic powder. The electrostatic image formed on a latent image carrier is developed by the toner, and the developed toner image is transferred onto a transfer material, such as normal paper or a plastic film. The toner image on the transfer material is fixed by a fixing device, such as a heating fixing means, a pressure roller fixing means or a heating and pressurizing roller fixing means. Thus, the binder resin used in the toner is characterized in that it is plastically deformed when applied with heat and/or pressure.

A currently employed method of preparing the toner or the coloring resin powder for toner includes the steps of melting and kneading a mixture consisting of at least a binder resin and a coloring agent or magnetic powder (and a tertiary component, when necessary ), cooling the kneaded mixture, pulverizing the cooled mixture and classifying the pulverized material. Pulverization of the cooled material generally consists of coarse grinding (or intermediate grinding) by a mechanical impact type pulverizer, and subsequent fine pulverization by a collision type pneumatic pulverizer using a jet of gas.

In the collision type pneumatic pulverizer using a jet of gas, the powder material is conveyed by a jet of gas and is made to collide against the colliding member, whereby the powder material is pulverized.

The conventional pulverizers are those shown in FIGS. 8, 9, 10 and 11.

The toners for developing the electrostatic image manufactured using the collision type pneumatic pulverizers shown in FIGS. 8, 9, 10 and 11 are substantially satisfactory but could be improved. Also, in recent years, there has been a demand for a toner having a smaller particle size which can be used to achieve high definition and high quality images and a demand for a method of manufacturing a toner more efficiently.

SUMMARY OF THE INVENTION

An object of the present invention is to provide a novel collision type pneumatic pulverizer which can overcome the aforementioned problems of the conventional techniques and which is capable of pulverizing powder material efficiently.

Another object of the present invention is to provide a collision type pneumatic pulverizer which enables generation of agglomerate to be reduced.

Still another object of the present invention is to provide a collision type pneumatic pulverizer which enables less melted powder to be generated in a pulverizing chamber.

Still another object of the present invention is to provide a collision type pneumatic pulverizer which is capable of efficiently producing powder having a small particle size and having a narrow particle size distribution.

Still another object of the present invention is to provide a collision type pneumatic pulverizer which enables excessive pulverization to be restricted.

Still another object of the present invention is to provide a process of efficiently producing a toner for developing electrostatic image which can overcome the aforementioned problems of conventional techniques.

In order to achieve the above objects, according to one aspect of the present invention, there is provided a pneumatic pulverizer which comprises an accelerating tube for conveying and accelerating a material to be pulverized by a high-pressure gas, and a pulverizing chamber for finely pulverizing the material to be pulverized. The pulverizing chamber is provided with a colliding member having a colliding surface provided in opposed relation to an opened surface of an outlet of the accelerating tube. The colliding surface of the colliding member has a protruding central portion, and an outer peripheral colliding surface provided around the protruding central portion for secondarily pulverizing the material primarily pulverized by the protruding central portion by collision. The pulverizing chamber has a side wall for performing tertiary pulverization on the material secondarily pulverized by the outer peripheral colliding surface by collision.

According to another aspect of the present invention, there is provided a process for producing a toner, which comprises the steps of melt-kneading a mixture which contains at least a binder resin and a coloring agent, cooling and solidifying the kneaded material, grinding the solid material to obtain the ground material, finely pulverizing the ground material by a collision type pneumatic pulverizer, and producing the toner from the finely pulverized material. The collision type pneumatic pulverizer includes an accelerating tube for conveying and accelerating the material to be pulverized by a high-pressure gas, and a pulverizing chamber for finely pulverizing the material to be pulverized. The material to be pulverized which is supplied and accelerated in the accelerating tube is discharged from an outlet of the accelerating tube into the pulverizing chamber. The discharged material is primarily pulverized by a protruding portion of a colliding member having a colliding surface provided in opposed relation to an opened surface of the outlet of the accelerating tube. The primarily pulverized material is secondarily pulverized by an outer peripheral surface provided on an outer periphery of the protruding portion, and the secondarily pulverized material undergoes tertiary pulverization by a side wall of the pulverizing chamber.

DETAILED DESCRIPTION OF THE PREFERRED EMBODIMENTS

The present invention will be described in detail by way of example.

First Embodiment

Figure 1:
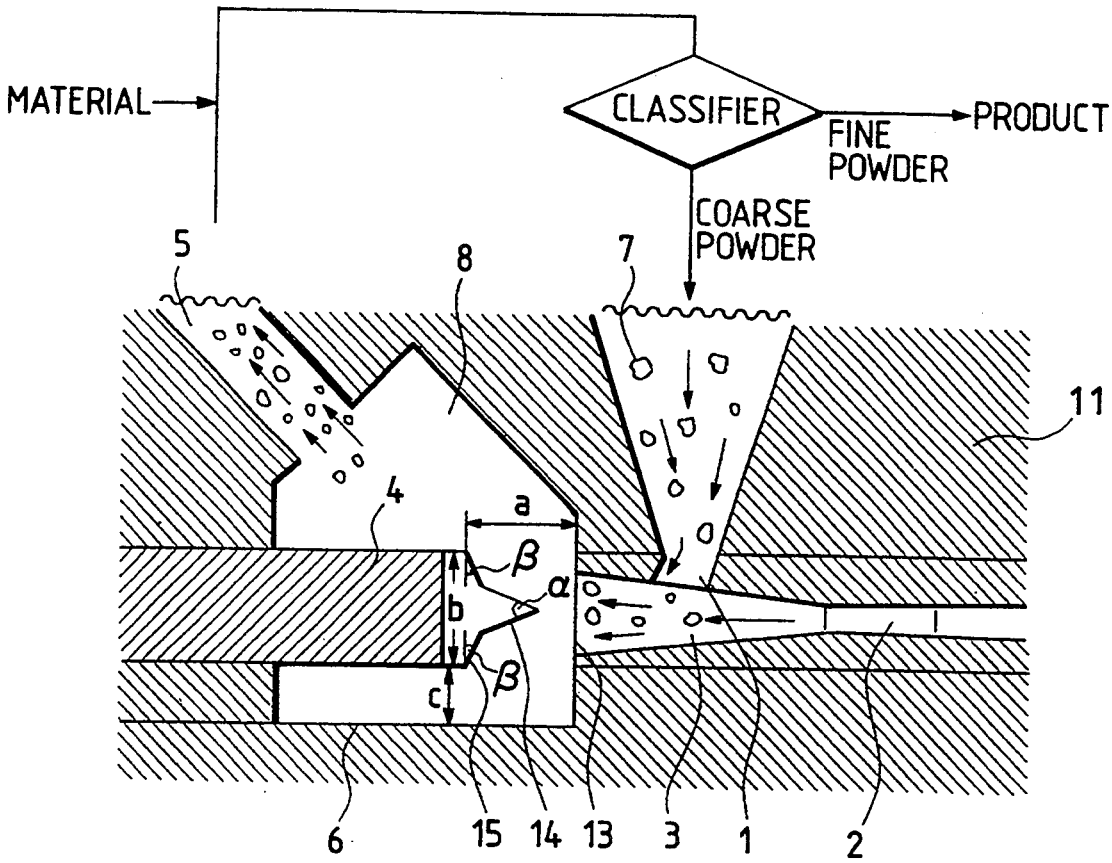
FIG. 1 is a schematic cross-sectional view of a first embodiment of a collision type pneumatic pulverizer according to the present invention.

FIG. 1 is a schematic cross-sectional view of a first embodiment of the present invention and a flowchart of a pulverizing apparatus in which the pulverization process by the pulverizer and the classification process by a classifier are combined.

A powder material 7 to be pulverized is supplied into an accelerating tube 3 from a powder material port 1 provided in a wall 11 of the pulverizer above the accelerating tube 3. The powder material 7 supplied into the accelerating tube 3 is accelerated in an instant by a compressed gas, such as compressed air, supplied into the accelerating tube 3 from a compressed gas supply nozzle 2. The powder material 7 discharged from an outlet 13 of the accelerating tube at a high speed collides against the colliding surface of a colliding member 4 and is thereby pulverized. In the pulverizer shown in FIG. 1, the colliding surface of the colliding member has a conically protruding central portion 14 and an outer peripheral colliding surface 15 provided around the protruding central portion for further pulverizing the powder primarily pulverized by the protruding central portion 14 by collision. Also, a pulverizing chamber 8 has a side wall 6 which performs tertiary pulverization by collision on the powder secondarily pulverized by the outer peripheral colliding surface.

Figure 2:
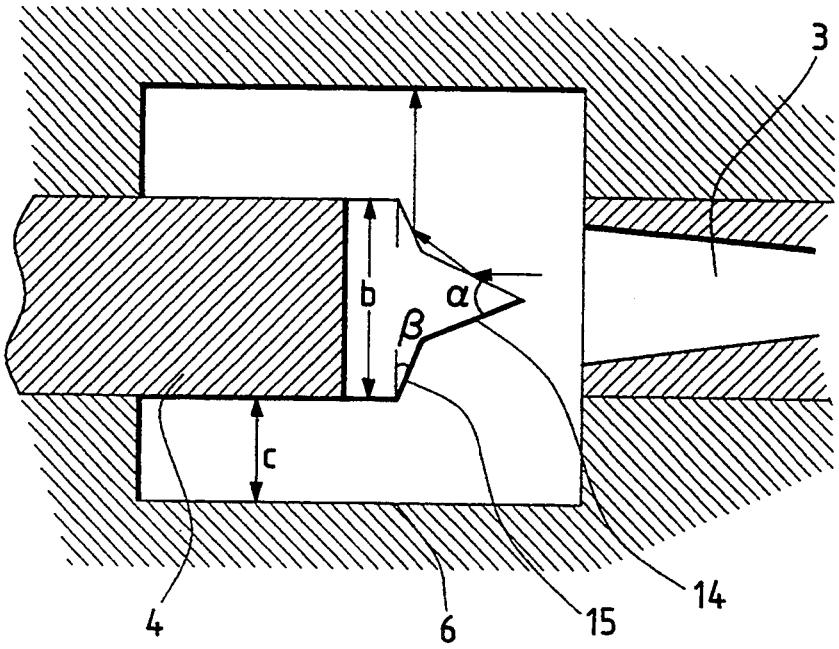
FIG. 2 is a horizontal plan view of FIG. 1.

FIG. 2 is a horizontal plan view of FIG. 1.

In the above-mentioned pulverizer, the flow of the solid and gas mixture of powder material and compressed air which is ejected from the accelerating tube is primarily pulverized by the surface of the conical protrusion 14 provided at the central portion of the colliding surface, and is then secondarily pulverized by the outer peripheral colliding surface 15. The secondarily pulverized solid and gas mixture undergoes tertiary pulverization by the side wall 6 of the pulverizing chamber. At that time, very efficient pulverization can be achieved when the vertical angle $\alpha$(°) of the protruding central portion which protrudes from the colliding surface of the colliding member and an inclined angle $\beta$ (°) of the outer peripheral colliding surface with respect to the surface perpendicular to the central axis of the accelerating tube satisfy the conditions expressed by $0<\alpha<90$ and $\beta>0$ (desirably, $10\leqq\alpha\leqq80$ and $5\leqq\beta\leqq40$) and $30\leqq\alpha+2\beta\leqq90$.

When $\alpha\geqq90$, the reflected flow of the powder which is primarily pulverized by the protruding surface may undesirably disturb the flow of the solid and gas mixture ejected from the accelerating tube.

When $\beta=0$ (in the case shown in FIG. 11), i.e., when the outer peripheral colliding surface is at a right angle to the flow of solid and gas mixture, the reflected flow generated by the outer peripheral colliding surface is directed against the flow of solid and gas mixture, undesirably disturbing the flow of solid and gas mixture.

Also, when $\beta=0$, the concentration of the powder on the outer peripheral colliding surface is increased. Thus, when a powder material composed of or mainly composed of a thermoplastic resin is used, attachment and agglomeration of the powder readily occur on the outer peripheral colliding surface. This makes the stable operation of the pulverizing apparatus difficult.

When $\alpha+2\beta<30$, the impact force of the primary pulverization on the protruding surface is reduced, thus reducing the pulverization efficiency.

When $\alpha+2\beta>90$, the reflected flow generated by the outer peripheral colliding surface is directed toward the downstream side of the flow of solid and gas mixture, reducing the impact force of the tertiary pulverization on the side wall of the pulverizing chamber and hence the pulverization efficiency.

As mentioned above, when $\alpha$ and $\beta$ satisfy the conditions expressed by $0<\alpha<90$ and $\beta>0$ (desirably, $10\leqq\alpha\leqq80$ and $5\leqq\beta\leqq40$) and $30\leqq\alpha+2\leqq90$, primary, secondary and tertiary pulverizations can be performed efficiently, as shown in FIG. 2, thus enhancing the pulverization efficiency.

When compared with the conventional collision type pneumatic pulverizer, the pulverizer according to the present invention is characterized by an increased number of collisions and more efficient collision. Thus, the pulverizer according to the present invention ensures improved pulverization efficiency, prevention of producing of melt-adhesion powder during pulverization, and stable operation.

Second Embodiment

Figure 3:
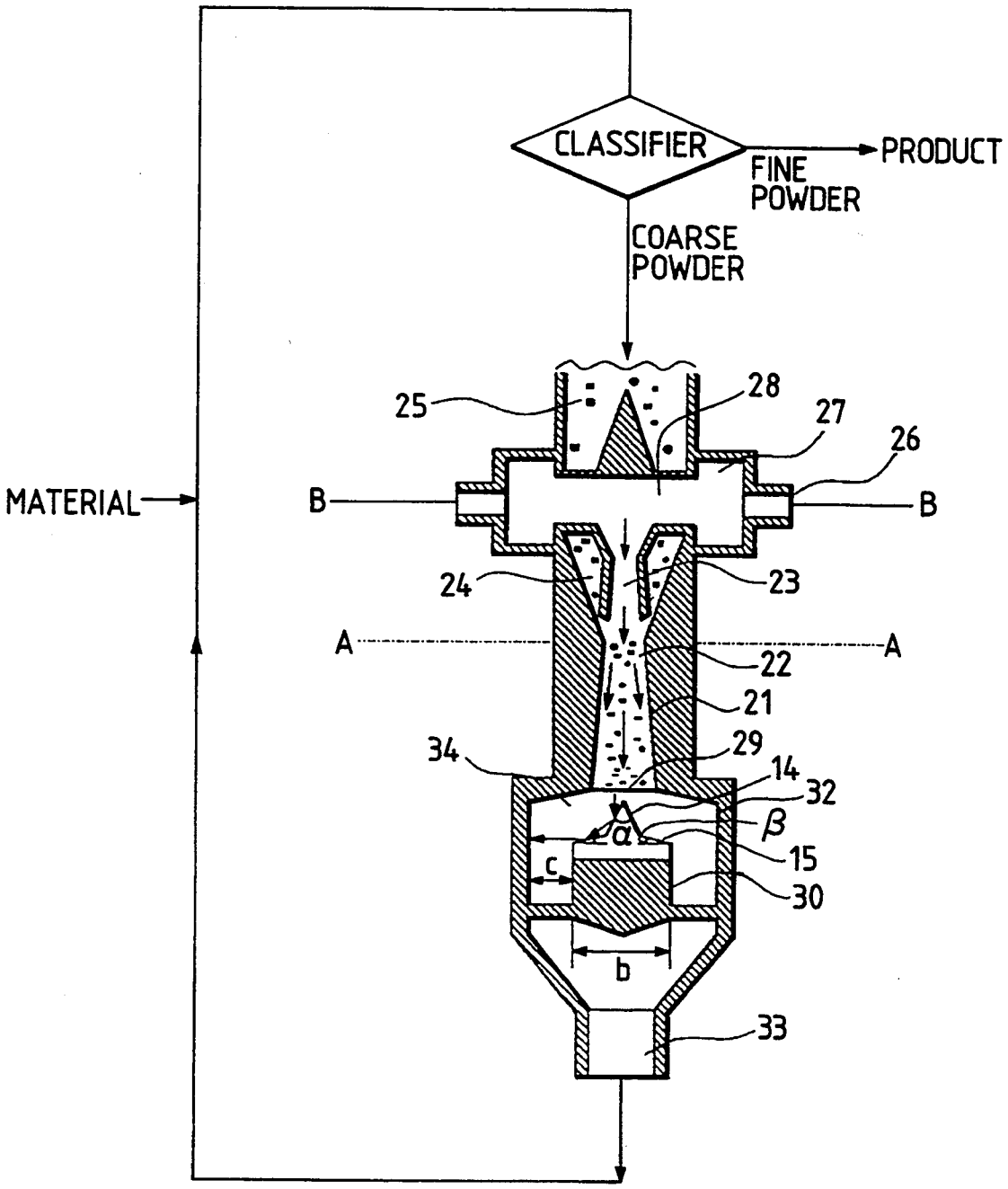
FIG. 3 is a schematic cross-sectional view of a second embodiment of the collision type pneumatic pulverizer according to the present invention.
Figure 4:
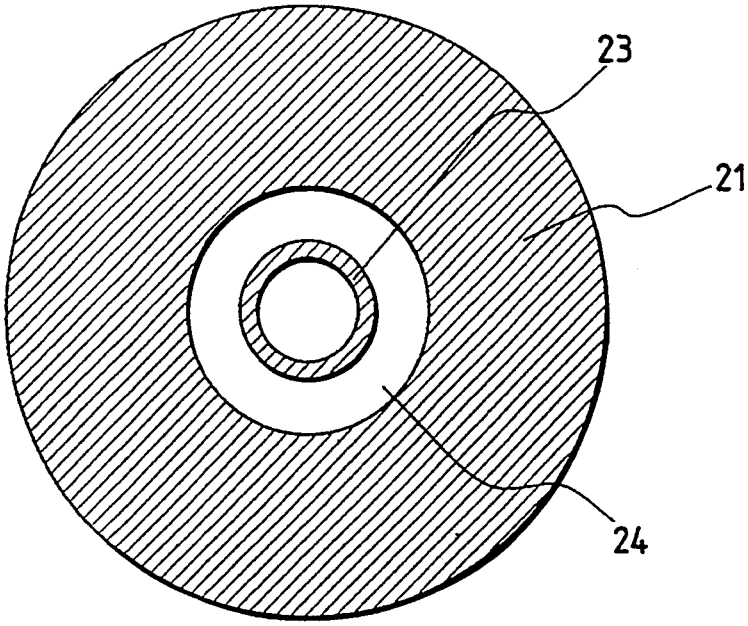
FIG. 4 is an enlarged section taken along the line A—A of FIG. 3.
Figure 5:
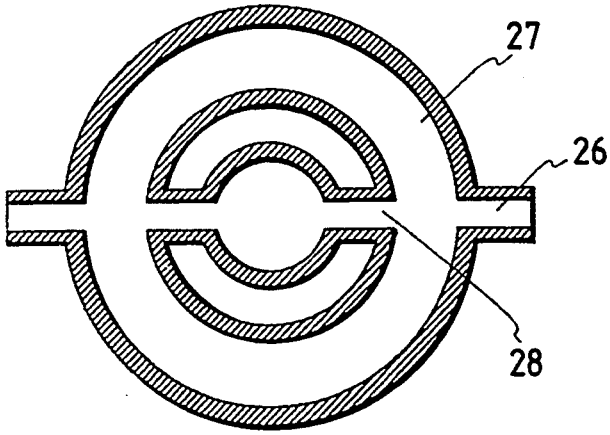
FIG. 5 is an enlarged section taken along the line B—B of FIG. 3.

The structure of the pulverizer according to the present invention is not limited to that shown in FIG. 1. FIG. 3 is a schematic cross-sectional view of another preferred embodiment of the present invention and a flowchart of a pulverizing apparatus which includes a combination of the pulverization process which employs the pulverized and the classification process by a classifier. FIG. 4 is an enlarged cross-sectional view taken along the line A—A of FIG. 3. FIG. 5 is a cross-sectional view taken along the line B—B of FIG. 3.

The pulverizer shown in FIG. 3 will be described below. The pulverizer has an accelerating tube 21 for conveying and accelerating the material powder to be pulverized by a high-pressure gas, and a colliding member 30 having a colliding surface disposed in opposed relation to the outlet of the accelerating tube. The accelerating tube 21 has a Laval nozzle-like shape. A high-pressure gas ejection nozzle 23 is disposed on the upstream side of the throat portion of the accelerating tube 21, and a material supply port 24 is provided between the outer wall of the high-pressure gas ejection nozzle 23 and the inner wall of the throat portion 22. The pulverizing chamber connected to the outlet of the accelerating tube 21 has a circular cross-sectional form and hence has a cylindrical side wall.

The material supplied from a material supply cylinder 25 reaches the material supply port 24 formed between the inner wall of the throat portion 22 of the accelerating tube 21 whose central axis is disposed in the vertical direction and having a Laval nozzle form and the outer wall of the high-pressure gas ejection nozzle 23 which is disposed coaxially with respect to the accelerating tube 21. A high-pressure gas introduced from a high-pressure gas supply port 26 passes first through a high-pressure gas chamber 27 and then through a single or a plurality of high-pressure gas introducing pipes 28, and is ejected from the high-pressure gas ejection nozzle 23 toward the outlet 29 of the accelerating tube while being rapidly expanded. At that time, the material accompanied by the gas is sucked from the material supply port 24 toward the outlet 29 of the accelerating tube due to the ejector effect generated near the throat portion 22 of the accelerating tube. At the throat portion 22 of the accelerating tube, the material is rapidly accelerated while being uniformly mixed with the high-pressure gas flow, and then collides with the colliding surface of the colliding member 30 disposed in opposed relation to the outlet 29 of the accelerating tube in a state of the solid and gas mixture in which the powder is mixed with the gas uniformly without partial concentration of powder.

Since the impact force generated during collision is applied to the sufficiently dispersed individual particles (material to be pulverized), very efficient pulverization can be achieved. The material pulverized by the colliding surface of the colliding member 30 repeatedly collides with the side wall 32 of the pulverizing chamber and the surface of the colliding member 30 to enhance the pulverization efficiency, and is then discharged from an exhaust port 33 disposed behind the colliding member 30.

The colliding surface of the colliding member has a protruding central portion 14 and an outer peripheral colliding surface 15 provided around the protruding central portion for further pulverizing the powder primarily pulverized by the protruding central portion by collision. The pulverizing chamber 34 has a side wall 32 for further pulverizing the powder secondarily pulverized by the outer peripheral colliding surface 15 by collision.

As in the case of the pulverizer shown in FIG. 1, the material powder to be pulverized is primarily pulverized by the surface of the protrusion on the colliding surface, and is then secondarily pulverized by the outer peripheral colliding surface 15. The secondarily pulverized powder material undergoes tertiary pulverization by the side wall 32 of the pulverizing chamber.

In the pulverizer shown in FIG. 3, the accelerating tube is disposed in the vertical direction, and the material powder to be pulverized is supplied between the inner wall of the accelerating tube and the outer wall of the high-pressure gas ejection nozzle. That is, the direction in which the high-pressure gas is ejected is made the same as that in which the material powder is supplied. Consequently, the material powder to be pulverized can be dispersed uniformly without partial concentration of powder in the high-pressure gas flow to be ejected.

Third Embodiment

Still another embodiment of the present invention will be described below with reference to FIGS. 6 and 7. FIG. 7 is a section taken along the line C—C of FIG. 6.

Figure 6:
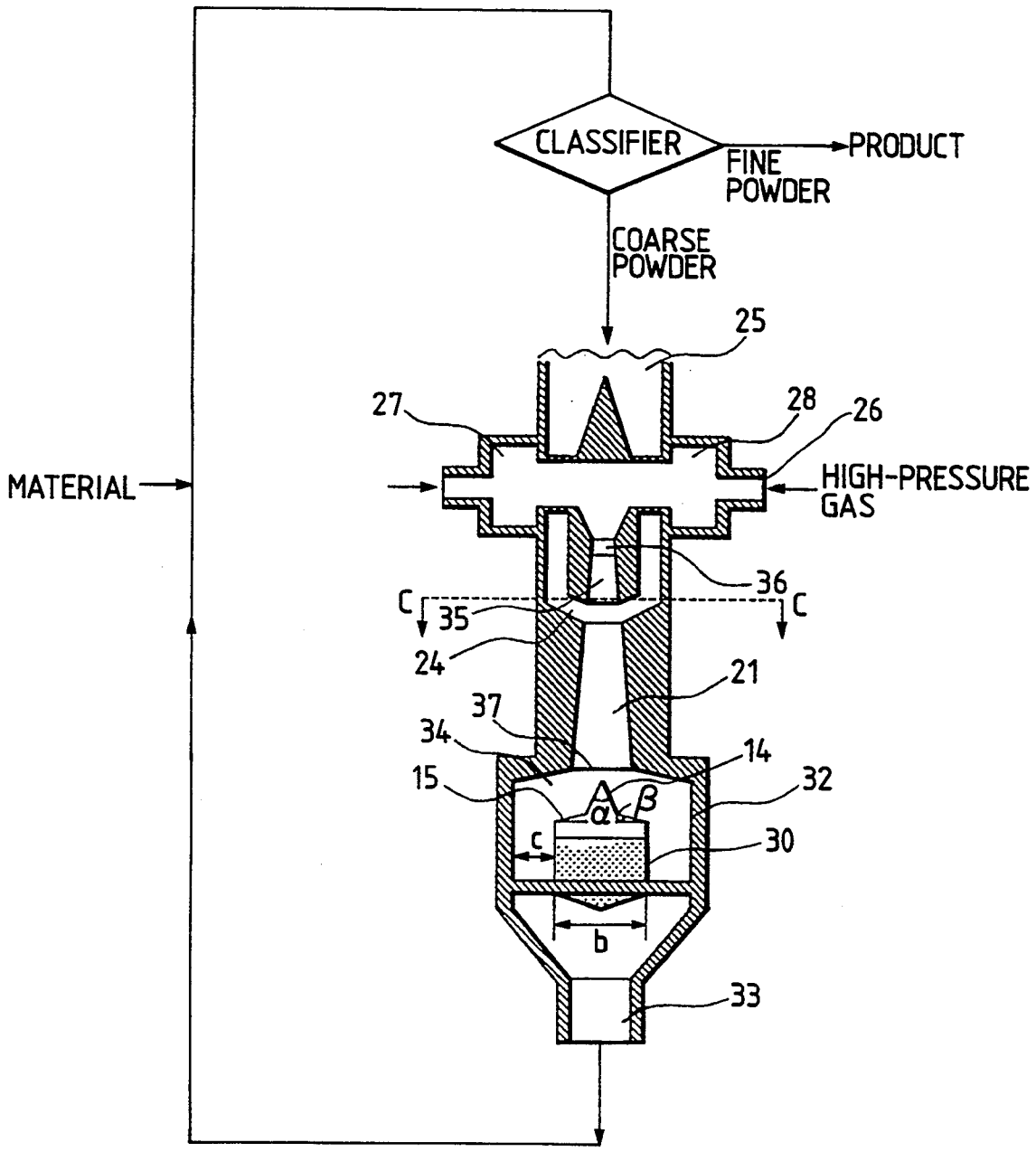
FIG. 6 is a schematic cross-sectional view of a third embodiment of the collision type pneumatic pulverizer according to the present invention.
Figure 7:
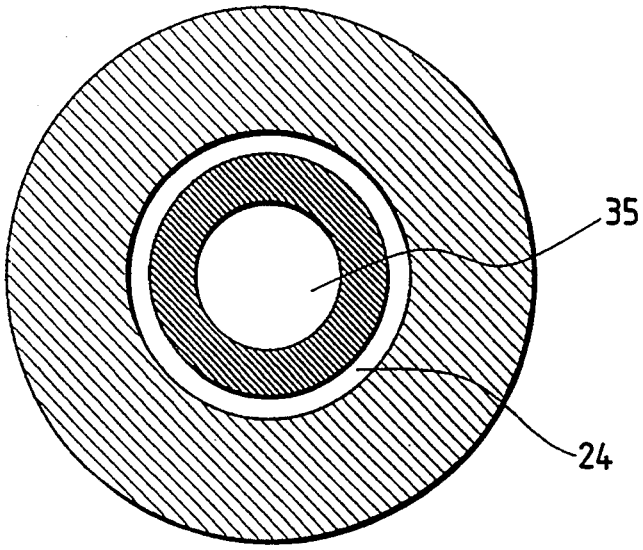
FIG. 7 is an enlarged cross-section taken along the line C—C of FIG. 6.

The pulverizer shown in FIG. 6 includes the accelerating tube 21 for conveying and accelerating the material powder by the high-pressure gas, and the pulverizing chamber 34 having the colliding surface for pulverizing the powder ejected from the accelerating tube 21 by collision. The colliding member 30 is disposed in opposed relation to the outlet of the accelerating tube. A powder material supply port 24 is provided in the entire circumferential direction of the accelerating tube between the throat portion 36 of the accelerating tube 21 having a Laval form and an outlet 37 of the accelerating tube. The pulverizing chamber has a substantially circular cross-sectional form. The exhaust port 33 is provided behind the colliding member 30.

The accelerating tube 21 is disposed such that the central axis thereof is directed in the vertical direction. The colliding surface of the colliding member 30 has the protruding central portion 14 and the outer peripheral colliding surface 15 provided around the protruding central portion for further pulverizing the powder primarily pulverized by the protruding central portion by collision. The pulverizing chamber 34 has the side wall 32 for further pulverizing the powder secondarily pulverized by the outer peripheral colliding surface 15 by collision.

The operation of the high-pressure gas will be explained. The high-pressure gas enters the high-pressure gas chamber 27 from the high-pressure gas supply ports 26 provided at the right and left sides thereof. After pulsations of the high-pressure gas, such as variations in the pressure, are eliminated, the high-pressure gas flows into the accelerating tube 21 from a Laval nozzle 35 provided at the central portion of the material powder supply cylinder 25.

Like the Laval nozzle 35, the accelerating tube 21 has a Laval form. The high-pressure gas which flows into the accelerating tube 21 is accelerated to a supersonic speed while being expanded. In the acceleration process, the pressure of the high-pressure gas is reduced. The pressure of the gas is reduced to a value which is substantially the same as that of the pulverizing chamber 34 by the time it comes out of the accelerating tube 21.

In the circular pulverizing chamber 34, when the gas in the pulverizing chamber 34 is sucked at the outlet 33, a suction flow occurs in the pulverizing chamber, thus reducing the pressure on the surface of the colliding member 30 by the action of this suction flow. The shape of the pulverizing chamber is not limited to the circular form shown in FIG. 6.

The jet of gas which comes out of the accelerating tube 21 is further accelerated by the reduction in the pressure on the surface of the colliding member 30. The accelerated jet of gas collides with the surface of the colliding member 30. At that time, the material powder to be pulverized is primarily pulverized by the surface of the protrusion 14 on the colliding surface of the colliding member 30, and is then secondarily pulverized by the outer peripheral colliding surface 15. Thereafter, the material powder undergoes tertiary pulveration by the side wall 32 of the pulverizing chamber.

The action subjected to the powder material to be supplied will be explained.

The powder material to be pulverized is supplied from the material supply cylinder 25. The supplied powder material is sucked into the accelerating tube 21 from the powder material supply port 24 located at the lower portion of the supply cylinder. The principle of suction and discharge of the material is the ejector effect caused by the expansion and pressure reduction of the high-pressure gas in the accelerating tube. At that time, since the powder material supply port 24 is provided in the entire circumferential direction of the accelerating tube between the throat portion of the accelerating tube having the Laval form and the outlet of the accelerating tube, the high-speed gas flow can be sufficiently dispersed and accelerated.

It is desirable that the powder material supply port 24 be provided in the entire circumferential direction. Alternatively, a plurality of powder material supply ports 24 may be provided. If a single powder material supply port is provided, the material is not dispersed in the accelerating tube uniformly, and the pulverization efficiency is thus reduced.

The powder material sucked into the accelerating tube 21 in a dispersed state is completely dispersed by the high-speed gas flow ejected from the Laval nozzle 35 provided at the central portion of the material supply cylinder 25.

The dispersed material is accelerated by the high-speed gas flow which flows in the interior of the accelerating tube 21, and thereby becomes a supersonic flow of solid and gas mixture. This supersonic flow of solid and gas mixture leaves the accelerating tube 21 as a jet of solid and gas mixture. The jet of solid and gas mixture is subjected to the same action as that applied to the aforementioned gas jet, and then collides with the colliding member 30.

In the pulverizer shown in FIG. 6, the accelerating tube is disposed such that the central axis thereof is directed in the vertical direction, and a special material supply method is used. Thus, the powder material to be pulverized is further dispersed, and the pulverization efficiency is enhanced. Consequently, an excellent pulverization ability is obtained.

Since the powder material to be pulverized is uniformly dispersed and the concentration thereof is thus made uniform, local attachment of the melted powder material in the colliding member, accelerating tube and pulverizing chamber or wear thereof can be greatly reduced as compared with the conventional collision type pneumatic pulverizer, thus providing stable operation.

The pulverizers shown in FIGS. 3 and 6 differ from that shown in FIG. 1 in the method of charging the material into the accelerating tube. The pulverizers shown in FIGS. 3 and 6 ensure uniform dispersion of the powder material in the accelerating tube, and thus enable the pulverization efficiency to be enhanced.

In the pulverizers shown in FIGS. 3 and 6, when $\alpha$ and $\beta$ satisfy the conditions expressed by $$0<\alpha<90,\ \beta>0$$

$$30\leqq\alpha+2\beta\leqq90,$$

efficient primary, secondary and tertiary pulverizations are performed, and the pulverization efficiency can thus be enhanced.

In the pulverizer according to the present invention, it is desirable that the inner diameter of the outlet of the accelerating tube be smaller than a diameter b of the colliding member. It is also desirable that the distal end of the central portion protruding from the colliding surface of the colliding member be substantially coincident with the central axis of the accelerating tube from the viewpoint of uniform pulverization. A distance a between the outlet of the accelerating tube and the end portion of the colliding surface of the colliding member is preferably 0.1 to 2.5 times as large as the diameter b of the colliding member, and more preferably, 0.2 to 1.0 times as large as the diameter b. When the distance a is less than 0.1 times, the concentration of the powder near the colliding surface is increased. When the distance a is more than 2.5 times, the impact force is reduced, thus reducing the pulverization efficiency.

A shortest distance c between the end portion of the colliding surface of the colliding member and the side wall (inner wall) of the pulverizing chamber is preferably 0.1 to 2 times as large as the diameter b of the colliding member. When the shortest distance c is less than 0.1 times, the pressure loss during the passage of the high-pressure gas is increased, reducing the pulverization efficiency and providing non-smooth flow of the powder material. When the shortest distance c is more than 2 times, the effect of the tertiary collision of the powder material on the side wall of the pulverizing chamber is reduced, reducing the pulverization efficiency. The pulverizing chamber can have any shape as long as the distance between the end portion of the colliding surface of the colliding member and the side wall of the pulverizing chamber satisfies the aforementioned value.

Example 1

| | |
|---|---|
| Styrene-butyl acrylate-divinylbenzene copolymer (monomer polymerization weight ratio 80.0/19.0/1.0 molecular weight 350,000) | 100 parts by weight |
| Magnetic iron oxide (average particle size 0.18 μm) | 100 parts by weight |
| Nigrosine | 2 parts by weight |
| Low-molecular-weight ethylene-propylene copolymer | 4 parts by weight |

After the substance having the above-mentioned composition was mixed well using Henschel mixer Model FM-75 (manufactured by Mitsui Miike Kakoki K. K.), it was kneaded at 150° C. by a biaxial kneader Model PCM-30 (manufactured by Ikegai Tekko K. K.). The resultant mixture was cooled, and then roughly pulverized to a particle size of 1 mm or less by a hammer mill to obtain a toner material. The obtained material was pulverized by the collision type pneumatic pulverizer shown in FIG. 1. In the collision type pneumatic pulverizer, the colliding surface had a conical protrusion whose vertical angle was 50° ($\alpha=50°$), and the inclined angle of the outer peripheral colliding surface with respect to the surface perpendicular to the central axis of the accelerating tube was 10° ($\beta=10°$), $\alpha+2\beta$ was 70°. The diameter of the colliding member was 90 mm (b=90 mm). The distance between the end portion of the colliding surface and the outlet of the accelerating tube was 50 mm (a=50 mm). The shortest distance to the wall of the pulverizing chamber was 20 mm (c=20 mm). The pulverizing chamber had a box-like shape. The toner material was supplied to a forced vortex type air classifier at a rate of 30 kg/H by a quantitative supplier. The classified roughly divided powder was introduced to the collision type pneumatic pulverizer and was pulverized using a compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 8.0 μm. Attachment of the melted powder did not occur, and stable operation was obtained.

Although various methods can be used to measure the particle size distribution of the finely pulverized powder or toner, a Coulter counter was used in the present invention.

An interface (manufactured by Nikkaki K. K.) for outputting the number distribution and volume distribution and a CX-1 personal computer (manufactured by Canon) were connected to the Coulter counter Model TA-II (manufactured by Coulter) which was the measuring device. 1% NaCl aqueous solution was prepared as an electrolyte using extra pure sodium chloride. 0.1 to 5 ml of a surface active agent (desirably, alkylbenzenesulfonate) was added to 100 to 150 ml of the above-mentioned electrolyte as a dispersant. Thereafter, 2 to 20 mg of sample to be measured was added to the electrolyte. The electrolyte in which the sample was suspended was subjected to dispersion for about 1 to 3 minutes by a supersonic disperser. Thereafter, distribution of 2 to 40 μ particles in the dispersed electrolyte was measured by the Coulter counter TA-II using a 100 μ aperture with the number as the standard to obtain the weight-average particle size of the sample.

Example 2

The same toner material as that used in Example 1 was pulverized by the collision type pneumatic pulverizer shown in FIG. 3. In this collision type pneumatic pulverizer, the colliding surface had a conical protrusion whose vertical angle was 55° ($\alpha=55°$), and the inclined angle of the outer peripheral colliding surface with respect to the surface perpendicular to the central axis of the accelerating tube was 10° ($\beta=10°$), $\alpha+2\beta$ was 75°. The diameter of the colliding member was 100 mm (b=100 mm). The distance between the end portion of the colliding surface and the outlet of the accelerating tube was 50 mm (a=50 mm). The pulverizing chamber had a cylindrical shape whose inner diameter was 150 mm (c=25 mm). The inclination of the axis of the accelerating tube with respect to the vertical line was substantially 0°. The toner material was supplied to a forced vortex type air classifier at a rate of 46 kg/H by a quantitative supplier. The classified roughly divided powder was introduced to the collision type pneumatic pulverizer and was pulverized using compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 8.1 μm. Attachment of the melted powder did not occur, and stable operation was obtained.

Example 3

The same toner material as that used in Example 1 was pulverized by the collision type pneumatic pulverizer shown in FIG. 6. In this collision type pneumatic pulverizer, the colliding surface had a conical protrusion whose vertical angle was 55° ($\alpha=55°$), and the inclined angle of the outer peripheral colliding surface with respect to the surface perpendicular to the central axis of the accelerating tube was 10° ($\beta=10°$), $\alpha+2\beta$ was 75°. The diameter of the colliding member was 100 mm (b=100 mm). The distance between the end portion of the colliding surface and the outlet of the accelerating tube was 50 mm (a=50 mm). The pulverizing chamber had a cylindrical shape whose inner diameter was 150 mm (c=25 mm). The inclination of the axis of the accelerating tube with respect to the vertical line was substantially 0°. The powder material supply port was opened in the entire circumferential direction of the accelerating tube. The toner material was supplied to a forced vortex type air classifier at a rate of 45 kg/H by a quantitative supplier. The clasified roughly divided powder was introduced to the collision type pneumatic pulverizer and was pulverized using a compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 8.1 μm. Attachment of the melted powder did not occur, and stable operation was obtained.

Example 4

The same toner material as that used in Example 1 was pulverized by the collision type pneumatic pulverizer shown in FIG. 1. The collision type pneumatic pulverizer had the same structure as that used in Example 1. The toner material was supplied to a forced vortex type air classifier at a rate of 18 kg/H by a quantitative supplier. The classified roughly divided powder was introduced to the collision type pneumatic pulverizer and was pulverized using compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average diameter of 6.1 μm. Attachment of the melted powder did not occur, and stable operation was obtained.

Example 5

The same toner material as that used in Example 1 was pulverized by the collision type pneumatic pulverizer shown in FIG. 3. The collision type pneumatic pulverizer had the same structure as that used in Example 2. The toner material was supplied to a forced vortex type air classifier at a rate of 30 kg/H by a quantitative supplier. The classified roughly divided powder was introduced to the collision type pneumatic pulverizer and was pulverized using compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 6.0 μm. Attachment of the melted powder did not occur, and stable operation was obtained.

Example 6

The same toner material as that used in Example 1 was pulverized by the collision type pneumatic pulverizer shown in FIG. 6. The collision type pneumatic pulverizer had the same structure as that used in Example 3. The toner material was supplied to a forced vortex type air classifier at a rate of 29 kg/H by a quantitative supplier. The classified rought-y divided powder was introduced to the collision type pneumatic pulverizer and was pulverized using compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 6.1 μm. Attachment of the melted powder did not occur, and stable operation was obtained.

Comparative Example 1

Figure 8:
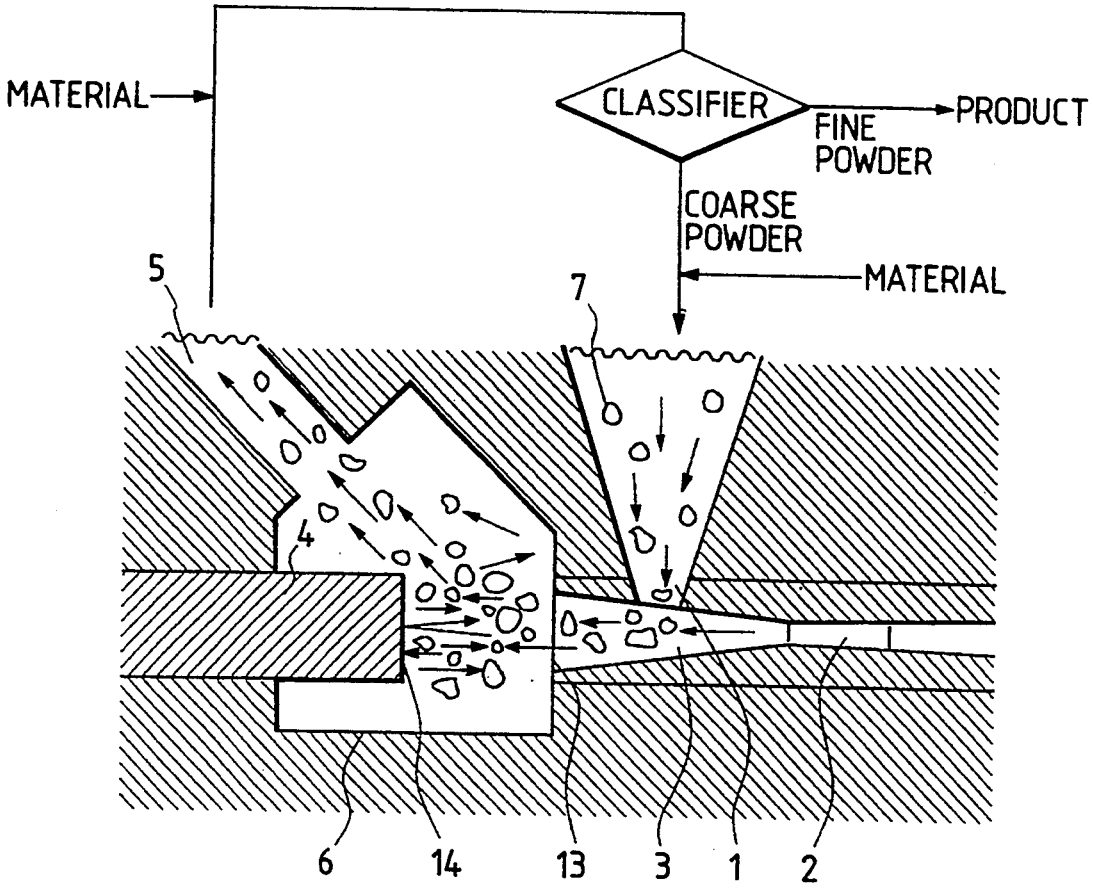
FIG. 8 is a schematic cross-sectional view of a conventional pulverizer.
Figure 9:
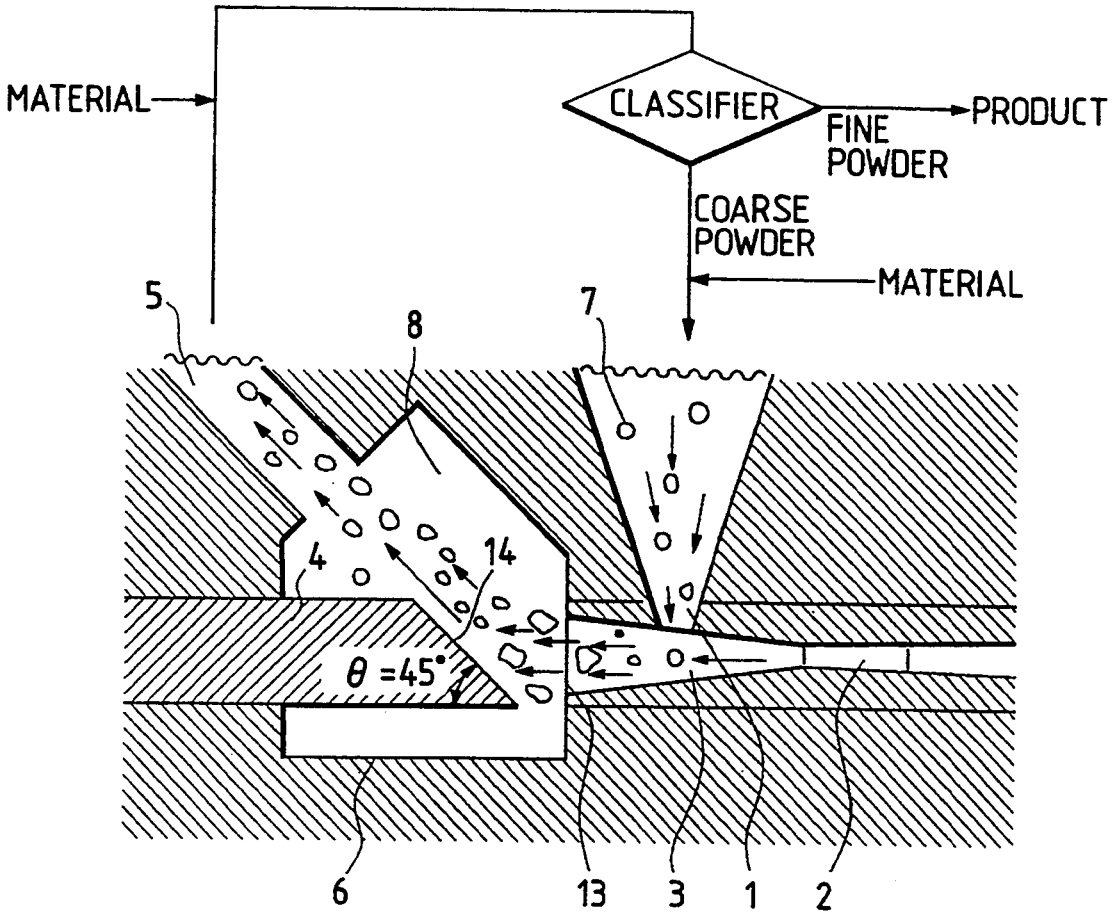
FIG. 9 is a schematic cross-sectional view of another conventional pulverizer.

The same toner material as that used in Example 1 was pulverized by the collision type pneumatic pulverizer shown in FIG. 8. The collision type pneumatic pulverizer had a flat colliding surface which was perpendicular to the axis of the accelerating tube ($\beta=0°$). The diameter of the colliding member was 90 mm (b=90 mm). The distance between the end portion of the colliding surface and the outlet of the accelerating tube was 50 mm (a=50 mm). The shortest distance to the wall of the pulverizing chamber was 20 mm (c=20 mm). The pulverizing chamber had a box-like shape. The toner material was supplied to a forced vortex type air classifier at a rate of 18 kg/H by a quantitative supplier. The classified roughly divided powder was introduced to the collision type pneumatic pulverizer and was pulverized using compressed air having a pressure of 6.0 kg/cm$^2$(G) , 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 8.3 μm. When the supply rate was increased to 18 kg/H or above, the volume-average particle diameter of the obtained finely divided powder increased. Also, attachment of the pulverized powder on the colliding member occurred, and agglomerate and rough particles were generated, clogging the material supply port of the accelerating tube. Thus, stable operation could not be obtained.

Comparative Example 2

Figure 10:
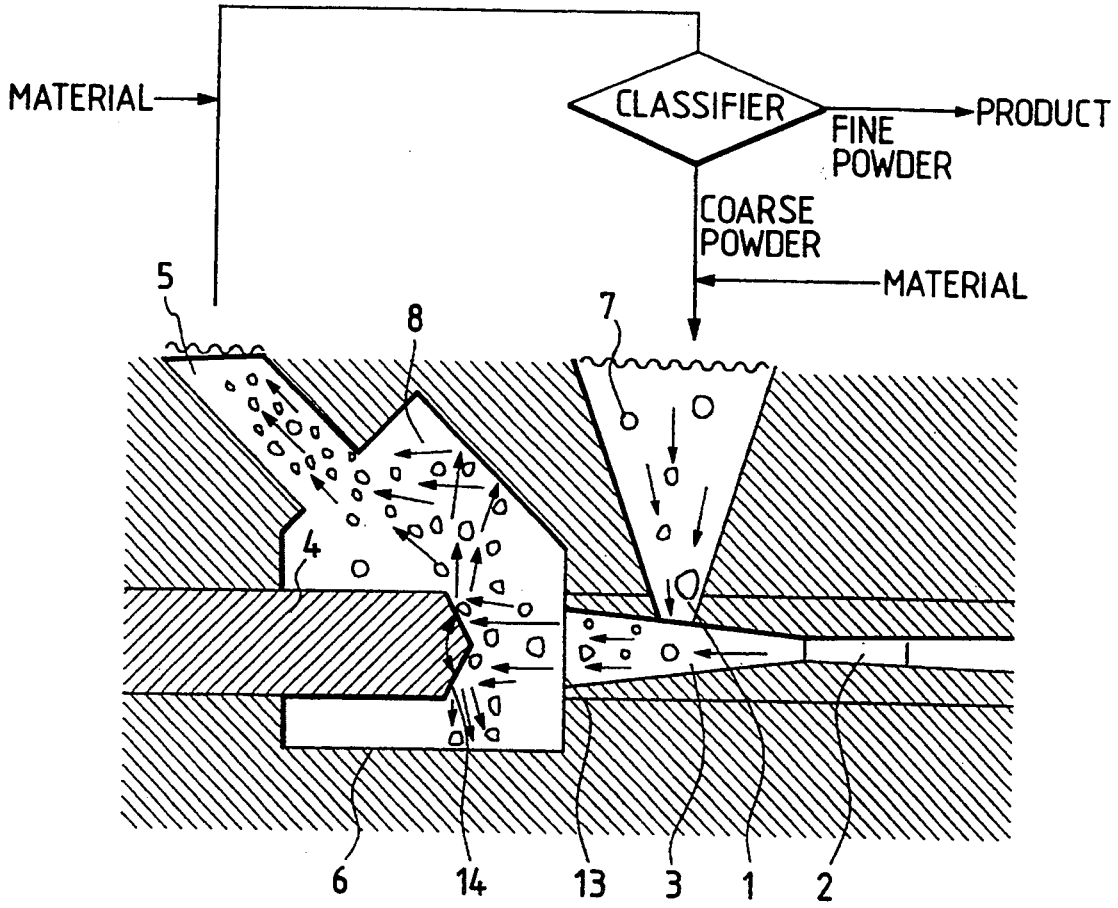
FIG. 10 is a schematic cross-sectional view of still another conventional pulverizer.

The same toner material as that used in Example 1 was pulverized by the collision type pneumatic pulverizer shown in FIG. 10. The collision type pneumatic pulverizer had a conical colliding surface whose vertical angle was 160°. The diameter of the colliding member was 90 mm (b=90 mm). The distance between the end portion of the colliding surface and the outlet of the accelerating tube was 50 mm (a=50 mm). The shortest distance to the wall of the pulverizing chamber was 20 mm (c=20 mm). The pulverizing chamber had a box-like shape. The toner material was supplied to a forced vortex type air classifier at a rate of 22 kg/H by a quantitative supplier. The classified roughly divided powder was introduced to the collision type pneumatic pulverizer and was pulverized using compressed air having a pressure of 6.0 kg/cm$^2$(G) , 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 8.2 μm. When the supply rate was increased to 22 kg/H or above, the weight-average diameter of the obtained finely divided power increased. Attachment of the melted powder did not occur.

Comparative Example 3

Figure 11:
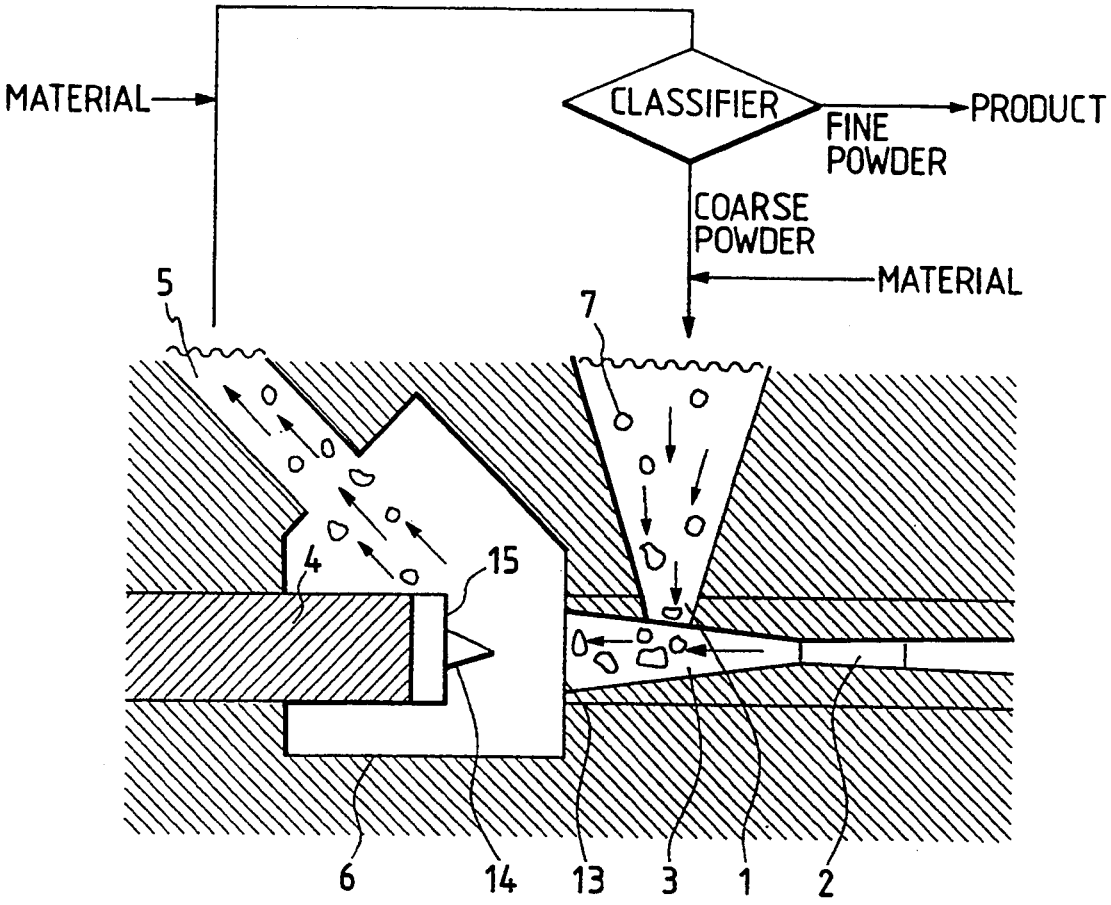
FIG. 11 is a schematic cross-sectional view of still another conventional pulverizer.

The same toner material as that used in Example 1 was pulverized by the collision type pneumatic pulverizer shown in FIG. 11. In the collision type pneumatic pulverizer, the colliding surface of the colliding member was at a right angle ($\beta$=0°) with respect to the axis of the accelerating tube. The colliding surface had a conical protrusion whose vertical angle was 50° ($\alpha$=50°). The diameter of the colliding member was 90 mm (b=90 mm). The distance between the end portion of the colliding surface and the outlet of the accelerating tube was 50 mm (a=50 mm). The shortest distance to the wall of the pulverizing chamber was 20 mm (c=20 mm). The pulverizing chamber had a box-like shape. The toner material was supplied to a forced vortex type air classifier at a rate of 22 kg/H by a quantitative supplier. The classified roughly divided powder was introduced to the collision type pneumatic pulverizer and was pulverized using compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 8.2 μm. When the supply rate was increased to 22 kg/H or above, the weight-average diameter of the obtained finely divided powder increased. Attachment of the rough particles did not occur. However, when the colliding member was inspected after one-hour of operation, it was confirmed that a thin layer of pulverized particles was attached to the colliding surface.

Comparative Example 4

The same toner material as that used in Example 1 was pulverized by the collision type pneumatic pulverizer shown in FIG. 8. The collision type pneumatic pulverizer had the same structure as that used in Comparative Example 1. The toner material was supplied to a forced vortex type air classifier at a rate of 8.0 kg/H by a quantitative supplier. The classified roughly divided powder was introduced to the collision type pneumatic pulverizer and was pulverized using compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 6.4 μm. When the supply rate was increased to 8.0 kg/H or above, the weight-average particle diameter of the obtained finely divided powder increased. Also, attachment of the pulverized powder on the colliding member occurred, and agglomerate and rough particles were generated, clogging the material supply port of the accelerating tube. Thus, stable operation could not be obtained.

Comparative Example 5

The same toner material as that used in Example 1 was pulverized by the collision type pneumatic pulverizer shown in FIG. 10. The collision type pneumatic pulverizer had the same structure as that used in Comparative Example 2. The toner material was supplied to a forced vortex type air classifier at a rate of 14 kg/H by a quantitative supplier. The classified roughly divided powder was introduced to the collision type pneumatic pulverizer and was pulverized using compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 6.2 μm. When the supply rate was increased to 14 kg/H or above, the weight-average particle diameter of the obtained finely divided powder increased. Attachment of the melted powder did not occur.

Comparative Example 6

The same toner material as that used in Example 1 was pulverized by the collision type pneumatic pulverizer shown in FIG. 11. The collision type pneumatic pulverizer had the same structure as that used in Comparative Example 3. The toner material was supplied to a forced vortex type air classifier at a rate of 14.0 kg/H by a quantitative supplier. The classified roughly divided powder was introduced to the collision type pneumatic pulverizer and was pulverized using a compressed air having a pressure of 6.0 kg/cm$^2$(G), 6.0 Nm$^3$/min. The pulverized powder was supplied again to the classifier, i.e., a closed circuit pulverization was performed. The obtained finely divided powder, which was the finely pulverized powder for toner, had a weight-average particle diameter of 6.1 μm. When the supply rate was increased to 14.0 kg/H or above, the weight-average particle diameter of the obtained finely divided powder increased. Attachment of the rough particles did not occur. However, when the colliding member was inspected after one-hour of operation, it was confirmed that a thin layer of pulverized particles was attached to the colliding surface.

The results of Examples 1 through 6 and Comparative Examples 1 through 6 are tabulated as follows:

| | Fine powder manufacturing device | Shape of the colliding surface | α (°) | β (°) | a (mm) | b (mm) | c (mm) | Supply rate (kg/h) | Weight-average diameter (μm) | Pulverization efficiency rate | Stability of the device |
|---|---|---|---|---|---|---|---|---|---|---|---|
| Example 1 | FIG. 1 | A conical shape having a central protrusion | 50 | 10 | 50 | 90 | 20 | 30.0 | 8.0 | 1.36 | ○ |
| Example 2 | FIG. 3 | ↑ | 55 | 10 | 50 | 100 | 25 | 46.0 | 8.1 | 2.09 | ○ |
| Example 3 | FIG. 6 | ↑ | 50 | 10 | 50 | 100 | 25 | 45.0 | 8.1 | 2.05 | ○ |
| Example 4 | FIG. 1 | ↑ | 55 | 10 | 50 | 90 | 20 | 18.0 | 6.1 | 0.82 | ○ |
| Example 5 | FIG. 3 | ↑ | 50 | 10 | 50 | 100 | 25 | 30.0 | 6.0 | 1.36 | ○ |
| Example 6 | FIG. 6 | ↑ | 55 | 10 | 50 | 100 | 25 | 29.0 | 6.1 | 1.32 | ○ |
| Comparative Example 1 | FIG. 8 | A flat shape | — | — | 50 | 90 | 20 | 18.0 | 8.3 | 0.82 | x |
| Comparative Example 2 | FIG. 10 | A conical shape | 160 | — | 50 | 90 | 20 | 22.0 | 8.2 | 1.0 | ○ |
| Comparative Example 3 | FIG. 11 | A conical shape having a central protrusion | 50 | 0 | 50 | 90 | 20 | 22.0 | 8.2 | 1.0 | Δ |
| Comparative Example 4 | FIG. 8 | A flat shape | — | — | 50 | 90 | 20 | 8.0 | 6.4 | 0.36 | x |
| Comparative Example 5 | FIG. 10 | A conical shape | 160 | — | 50 | 90 | 20 | 14.0 | 6.2 | 0.64 | ○ |
| Comparative Example 6 | FIG. 11 | A conical shape having a central protrusion | 50 | 0 | 50 | 90 | 20 | 14.0 | 6.1 | 0.64 | Δ |

In the above table, the pulverization efficiency rate is the rate of the amount of material powder supplied under each of the various conditions relative to the amount of material supplied in Comparative Example 2 which is 1.0.

In the present invention, the flow of solid and gas mixture ejected from the accelerating tube undergoes primarily pulverization by the conical protruding central portion provided on the colliding surface, and the primarily pulverized mixture undergoes secondary pulverization by the outer peripheral colliding surface provided around the protruding central portion. Thereafter, the mixture undergoes tertiary pulverization by the side wall of the pulverizing chamber. Thus, as compared with the conventional collision type pneumatic pulverizer, the pulverization efficiency is greatly enhanced. Furthermore, since the reflected flow generated by the collision is not directed toward the accelerating tube, disturbance of the flow of solid and gas mixture can be prevented, thus preventing generation of attachment of the melted particles on the colliding surface.

When the toner for developing electrostatic image is manufactured by the method according to the present invention, the flow of solid and gas mixture ejected from the accelerating tube undergoes primary pulverization by the conical protruding central portion provided on the colliding surface, and the primarily pulverized mixture undergoes secondary pulverization by the outer peripheral colliding surface provided around the protruding central portion. Thereafter, the mixture undergoes tertiary pulverization by the side wall of the pulverizing chamber. Thus, as compared with the conventional collision type pneumatic pulverizer, the pulverization efficiency is greatly enhanced. Furthermore, since the reflected flow generated by the collision is not directed toward the accelerating tube, disturbance of the flow of solid and gas mixture can be prevented, thus preventing generation of attachment of the melted particles on the colliding surface.

What is claimed is:

1. A pneumatic pulverizer comprising:

an accelerating tube for conveying and accelerating a powder material to be pulverized by a high-pressure gas, said accelerating tube including a powder material supply port and a throat portion; and a pulverizing chamber for finely pulverizing the material conveyed by said accelerating tube, said pulverizing chamber including a colliding member having a colliding surface provided opposite to an outlet of said accelerating tube, said colliding surface having a protruding central portion, and an inclined outer peripheral colliding surface provided on an outer periphery of said protruding central portion for secondarily pulverizing the powder material primarily pulverized by said protruding central portion, and wherein a vertical angle (α) of said protruding central portion is between 10° and 80° and an inclined angle (β) of said outer peripheral colliding surface with respect to a surface perpendicular to a central axis of said accelerating tube is between 5° and 40°, and wherein said pulverizing chamber has a side wall for performing tertiary pulverization on the powder material secondarily pulverized by said outer peripheral colliding surface.

2. The penumatic pulverizer according to claim 1, wherein said α and said β satisfy the following equations:

$$30 \leqq \alpha + 2\beta \leqq 90.$$

3. The pneumatic pulverizer according to claim 1, wherein said accelerating tube has an inner diameter smaller than a diameter of said colliding member at the outlet thereof.

4. The pneumatic pulverizer according to claim 1, wherein said colliding member is disposed such that a distance between the outlet of said accelerating tube and an end portion of said colliding surface of said colliding member is 0.1 to 2.5 times as large as a diameter of said colliding member.

5. The pneumatic pulverizer according to claim 1, wherein said colliding member is disposed such that a distance between the outlet of said accelerating tube and an end portion of said colliding surface of said colliding member is 0.2 to 1.0 times as large as a diameter of said colliding member.

6. The pneumatic pulverizer according to claim 1, wherein said colliding member is disposed such that a shortest distance between an end portion of said colliding surface of said colliding member and an inner wall of said pulverizing chamber is 0.1 to 2 times as large as a diameter of said colliding member.

7. The pneumatic pulverizer according to claim 1, wherein said pulverizing chamber has a cylindrical side wall.

8. The pneumatic pulverizer according to claim 1, wherein said pulverizing chamber has, behind said colliding member, an exhaust port through which the pulverized material is discharged.

9. The pneumatic pulverizer according to claim 1, wherein said accelerating tube has, at a rear end portion thereof, a material supply port through which the material to be pulverized is supplied to said accelerating tube, and a high-pressure gas ejecting nozzle through which the high-pressure gas is supplied to said accelerating tube.

10. The pneumatic pulverizer according to claim 1, wherein said accelerting tube is provided in the vertical direction such that the outlet thereof is directed downward.

11. A pneumatic pulverizer according to claim 1, wherein said colliding surface has a conically-shaped protruding central portion.

12. A process for producing a toner, comprising the steps of:

melt-kneading a mixture which contains at least a binder resin and a coloring agent;

cooling and solidifying the kneaded material;

grinding the solid material to obtain ground material;

finely pulverizing the ground material using a collision type pneumatic pulverizer; and producing the toner from the finely pulverized material, wherein the step of utilizing the collision type pneumatic pulverizer includes an accelerating tube for conveying and accelerating the powder material to be pulverized by a high-pressure gas, the accelerating tube having a powder material supply port and a throat portion, and a pulverizing chamber for finely pulverizing the powder material to be pulverized, the powder material to be pulverized being supplied and accelerated in the accelerating tube and discharged from an outlet of the accelerating tube into the pulverizing chamber, the discharged powder material being primarily pulverized by a colliding member having a colliding surface with a protruding portion opposed to an outlet of the accelerating tube, the primarily pulverized material being secondarily pulverized by an inclined outer peripheral surface provided on an outer periphery of the protruding portion, and the secondarily pulverized material undergoing tertiary pulverization by a side wall of the pulverizing chamber, wherein a vertical angle ($\alpha$) of the protruding central portion is between 10° and 80° and an inclined angle ($\beta$) of the outer peripheral colliding surface with respect to a surface perpendicular to a central axis of said accelerating tube is between 5° and 40°.

13. The process for producing a toner according to claim 12, wherein the powder material to be pulverized is pulverized by the colliding surface which satisfies the following equations:

$$30 \leqq \alpha + 2\beta \leqq 90.$$

14. The process for producing a toner according to claim 12, wherein the material to be pulverized is pulverized by both collision with the colliding surface of the colliding member and collision with the cylindrical side wall of the pulverizing chamber.

15. The process for producing a toner according to claim 12, wherein the material to be pulverized is supplied into this accelerating tube from a rear end portion of the accelerating tube.

16. The process for producing a toner according to claim 12, wherein the material to be pulverized is supplied into the accelerating tube from a surrounding portion of a high-pressure gas ejecting nozzle for supplying the high-pressure gas into the accelerating tube.

17. The process for producing a toner according to claim 12, wherein the colliding surface has a conically-shaped protruding central portion.

* * * * *

UNITED STATES PATENT AND TRADEMARK OFFICE

CERTIFICATE OF CORRECTION

PATENT NO. : 5,358,183 Page 1 of 2

DATED : October 25, 1994

INVENTOR(S) : Kanda et al.

It is certified that error appears in the above-indentified patent and that said Letters Patent is hereby corrected as shown below:

On title page, item

[56] REFERENCES CITED:

FOREIGN PATENT DOCUMENTS, insert the following:
--54-42141 4/1979 Japan
--55-18656 2/1980 Japan--.
"1148740 10/1989 Japan" and "1254266 10/1989 Japan" should read --1-148740 10/1989 Japan-- and 1-254266 10/1989 Japan--.

COLUMN 1:

Line 5, "continutation-in-part" should read --continuation--.

COLUMN 12:

Line 29, "rought-y" should read --roughly--.

COLUMN 15:

Table, "α should read --α

| "α (°) | --α (°) |
|---|---|
| 50 | 50 |
| 55 | 55 |
| 50 | 55 |
| 55 | 50 |
| 50" | 55--. |

COLUMN 16:

Line 54, "α" should read --(α)-- and "β" should read --(β)--.

UNITED STATES PATENT AND TRADEMARK OFFICE

CERTIFICATE OF CORRECTION

PATENT NO. : 5,358,183 Page 2 of 2

DATED : October 25, 1994

INVENTOR(S) : Kanda et al.

It is certified that error appears in the above-indentified patent and that said Letters Patent is hereby corrected as shown below:

COLUMN 17:

Line 28, "accelerting" should read --accelerating--.
Line 44, "utilizing" should read --using--.

COLUMN 18:

Line 36, "this" should read --the--.

Signed and Sealed this

Sixteenth Day of May, 1995

*Attest:*

Bruce Lehman

BRUCE LEHMAN

*Attesting Officer*

*Commissioner of Patents and Trademarks*